US010276966B1

(12) United States Patent
Hitchcock et al.

(10) Patent No.: US 10,276,966 B1
(45) Date of Patent: Apr. 30, 2019

(54) ELECTRICAL CONNECTOR WITH ALIGNMENT PLATE AND SEAL

(71) Applicant: TE CONNECTIVITY CORPORATION, Berwyn, PA (US)

(72) Inventors: Matthew Bryan Hitchcock, Lebanon, PA (US); Michael William Brenner, Greensboro, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/830,133

(22) Filed: Dec. 4, 2017

(51) Int. Cl.
*H01R 13/506* (2006.01)
*H01R 13/52* (2006.01)

(52) U.S. Cl.
CPC ..... *H01R 13/506* (2013.01); *H01R 13/521* (2013.01)

(58) Field of Classification Search
CPC ..... H01R 13/506; H01R 13/521; H01R 13/5202; H01R 13/62; H01R 13/422; H01R 13/428; H01R 13/434; H01R 13/5213
USPC ..... 439/693, 595, 246, 247, 248
See application file for complete search history.

(56) References Cited

U.S. PATENT DOCUMENTS 4,684,190 A * 8/1987 Clark ..... H01R 13/5219 439/277
4,810,208 A * 3/1989 Hayes ..... H01R 13/5208 439/281
4,944,688 A * 7/1990 Lundergan ..... H01R 13/443 439/275
4,973,268 A * 11/1990 Smith ..... H01R 13/4365 439/589
5,100,346 A * 3/1992 McCardell ..... H01R 13/111 439/595
5,151,052 A * 9/1992 McCardell ..... H01R 13/4364 439/595
5,328,382 A * 7/1994 Pawlicki ..... H01R 13/4364 439/273
5,575,685 A * 11/1996 Ittah ..... H01R 13/4365 439/488
5,964,621 A * 10/1999 Wolla ..... H01R 13/4364 439/595
5,993,255 A * 11/1999 Yurko ..... H01R 13/631 439/364
6,305,990 B1 * 10/2001 Ward ..... H01R 13/432 439/752
6,332,797 B1 * 12/2001 Taguchi ..... H01R 13/5208 439/275

(Continued)

*Primary Examiner* — Tulsidas C Patel
*Assistant Examiner* — Peter G Leigh

(57) ABSTRACT

An electrical connector assembly having a housing, an alignment plate, a back plate and a sealant. The housing has a bottom wall and a shroud extending therefrom. A recess is provided in the housing proximate the bottom wall, the recess extends in a direction away from the shroud. The alignment plate has housing latching members which extend through latch receiving openings in the bottom wall of the housing. The housing latching members and the alignment plate are movable between a first position and a second position. The back plate is positioned in the recess of the housing. The back plate has latching member receiving projections for receiving the housing latching members when the alignment plate is in the second position. The seal is positioned in the recess of the housing. The sealant positioned in the recess of the housing.

20 Claims, 3 Drawing Sheets

(56) References Cited

U.S. PATENT DOCUMENTS

| | | | | |
|---|---|---|---|---|
| 6,341,984 | B1 * | 1/2002 | Murakami | H01R 13/5208 439/587 |
| 6,390,859 | B2 * | 5/2002 | Furutani | H01R 13/4362 439/752 |
| 6,761,568 | B2 * | 7/2004 | Bakker | H01R 13/4538 439/140 |
| 7,261,603 | B2 * | 8/2007 | Takahashi | H01R 13/4361 439/595 |
| 7,500,887 | B2 * | 3/2009 | Ichio | H01R 13/4362 439/595 |
| 7,670,177 | B2 * | 3/2010 | Myer | H01R 13/4365 439/595 |
| 7,828,607 | B2 * | 11/2010 | Kojima | H01R 13/4362 439/595 |
| 8,075,351 | B2 * | 12/2011 | Park | H01R 13/40 439/372 |
| 8,096,841 | B2 * | 1/2012 | Hirano | H01R 13/4361 439/752 |
| 8,469,752 | B2 * | 6/2013 | Park | H01R 13/506 439/752 |
| 8,727,816 | B2 * | 5/2014 | Takahashi | H01R 13/4361 439/595 |
| 9,083,114 | B2 * | 7/2015 | Muro | H01R 13/627 |
| 9,153,896 | B2 * | 10/2015 | Akagi | H01R 13/506 |
| 9,509,093 | B2 * | 11/2016 | Shimizu | H01R 13/62938 |
| 9,553,388 | B2 * | 1/2017 | Endo | H01R 13/4364 |
| 2002/0168895 | A1 * | 11/2002 | Suzuki | H01R 13/4365 439/595 |
| 2005/0059280 | A1 * | 3/2005 | Hobbs | H01R 13/4538 439/140 |

* cited by examiner

ELECTRICAL CONNECTOR WITH ALIGNMENT PLATE AND SEAL

FIELD OF THE INVENTION

The invention is directed to an electrical connector assembly with an alignment plate and seal which cooperates and supports electrical terminals of the connector assembly. In particular, the invention is directed to an electrical connector assembly with an alignment plate which retains the electrical terminals in position and which does not interfere with the seal of the connector assembly.

BACKGROUND OF THE INVENTION

Electrical connectors may be used to transfer data and/or electrical power between different systems or devices. Electrical connectors are often designed to operate in challenging environments where contaminants, shock and/or vibration can disrupt the electrical connection. For example, automobiles and other machinery utilize electrical connectors to communicate data and/or electrical power therein. At least some known electrical connectors include a connector housing that has a cavity configured to receive another electrical connector (hereinafter referred to as a "mating connector"). The cavity opens to a front end of the connector housing and extends a depth into the connector housing. The electrical connector includes an array of electrical contacts, and the mating connector includes a complementary array of electrical contacts (hereinafter referred to as "mating contacts"). As the mating connector is received within the cavity, the electrical contacts are received within corresponding socket openings of the mating connector. Each socket opening may include one of the mating contacts that engages the corresponding electrical contact to establish an electrical connection.

Many times harnesses must be assembled and/or preassembled, where one part of the connector is not mated with the corresponding connector until sometime further in the overall assembly process. Thus, this requires a great deal of care for socket connectors of the type having a header and a plurality of upstanding tabs and/or pins.

Although the connector housing partially surrounds the electrical contacts within the receiving cavity, the electrical contacts may be exposed to the ambient environment through the open front end. During shipping or handling of the electrical connectors, contaminants may enter the receiving cavity through the front end. In addition, the front end may permit objects to enter the receiving cavity and engage the electrical contacts thereby moving and/or bending the electrical contacts. If an electrical contact is not positioned properly within the receiving cavity, the electrical contact may improperly engage the mating connector, an incident referred to as stubbing, which can damage the electrical contact. In some cases, the damage may require the electrical contact or, potentially, the entire electrical connector to be replaced.

In some connection systems, the headers are provided with freestanding pins without any type of support surrounding the pins. In other connection systems, alignment plates may be provided but are difficult to use with sealed connectors, as the clearance required for the movement of the alignment plates prevents proper sealing of the connector.

Accordingly, there is a need for an electrical connector assembly having a mechanism for maintaining proper alignment of the pins while allowing for the connector assembly to be sealed.

SUMMARY OF THE INVENTION

An embodiment is directed to an electrical connector assembly having a housing, an alignment plate, a back plate and a sealant. The housing has a bottom wall and a shroud extending therefrom. A recess is provided in the housing proximate the bottom wall, the recess extends in a direction away from the shroud. The alignment plate has housing latching members which extend through latch receiving openings in the bottom wall of the housing. The housing latching members and the alignment plate are movable between a first position and a second position. The back plate is positioned in the recess of the housing. The back plate has latching member receiving projections for receiving the housing latching members when the alignment plate is in the second position. The sealant positioned in the recess of the housing.

An embodiment is directed to an electrical connector assembly having a housing, an alignment plate, and a back plate. The housing has a bottom wall and a shroud extending therefrom. A recess is provided in the housing proximate the bottom wall, the recess extends in a direction away from the shroud. Terminals extend through the bottom wall. The alignment plate has housing latching members and housing retention members. The housing latching members extend through latch receiving openings in the bottom wall of the housing. The housing retention members extend through retention member receiving openings in the bottom wall of the housing. The housing latching members, the housing retention members and the alignment plate being movable between a first position and a second position. The back plate is positioned in the recess of the housing. The back plate has latching member receiving projections for receiving the housing latching members when the alignment plate is in the second position. The back plate has retention member receiving projections for receiving the housing retention members.

An embodiment is directed to a method of providing terminal alignment to a sealed connector. The method includes: positioning a terminal alignment plate proximate a wall of a housing having a bottom wall, the housing having a recess provided in the housing proximate the bottom wall; and moving housing latching members through latch receiving openings in the bottom wall of the housing into latching member receiving projections in a back plate positioned in the recess of the housing as the alignment plate is moved from a first position to a second position. Additionally, the method may include: moving housing retention members through retention member receiving openings in the bottom wall of the housing into retention member receiving projections in the back plate positioned in the recess of the housing as the alignment plate is moved from the first position to the second position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
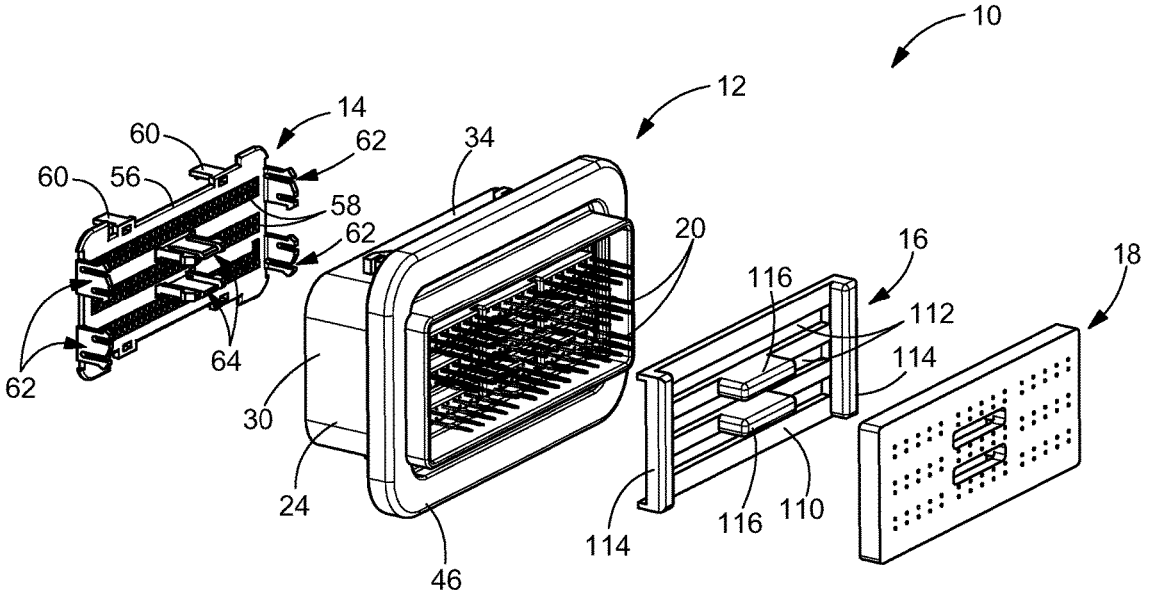
FIG. 1 is an exploded perspective view of an illustrative embodiment of a sealed header according to the present invention.
Figure 2:
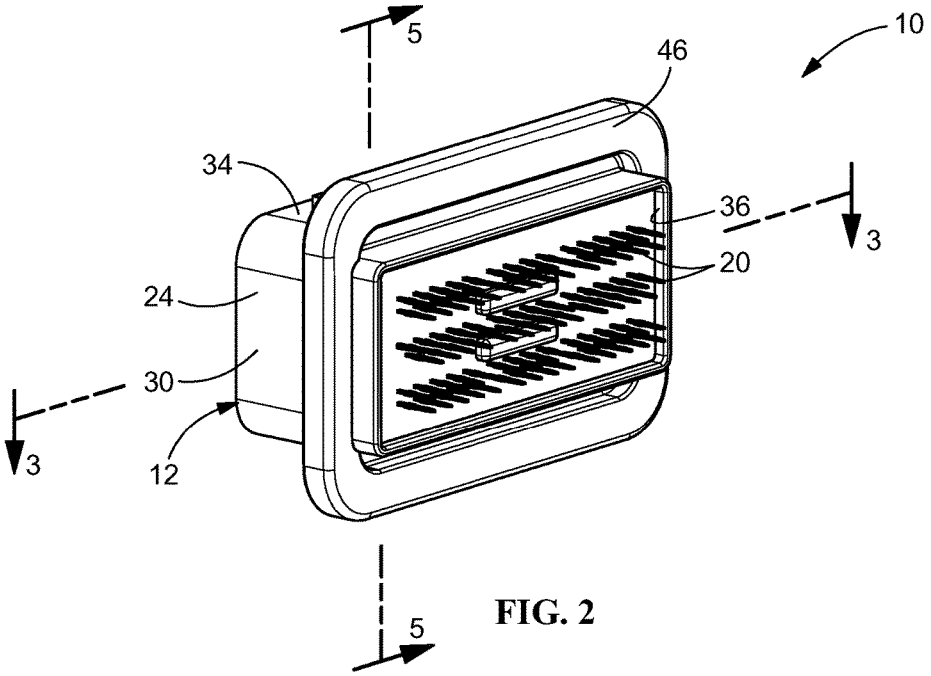
FIG. 2 is a perspective view of the sealed header of FIG. 1 shown in an assembled position.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

As best shown in FIGS. 1 through 4, a header assembly 10 includes a housing 12, a terminal alignment plate 14, a back plate 16 and a sealant 18. Contacts or terminals 20 are provided in the housing. The contacts or terminals 20 may be pin contacts, tabs or other known types of contacts.

The housing 12 generally includes a bottom wall 22 with a shroud 24 extending therefrom. The shroud 24 has end walls 28, 30 and side walls 32, 34. A recess 36 is provided in the bottom wall 22 and extends in a direction away from the shroud 24. The housing 12 further includes a lower flange portion 46, which circumscribes the housing 12 proximate the bottom wall 22.

Figure 3:
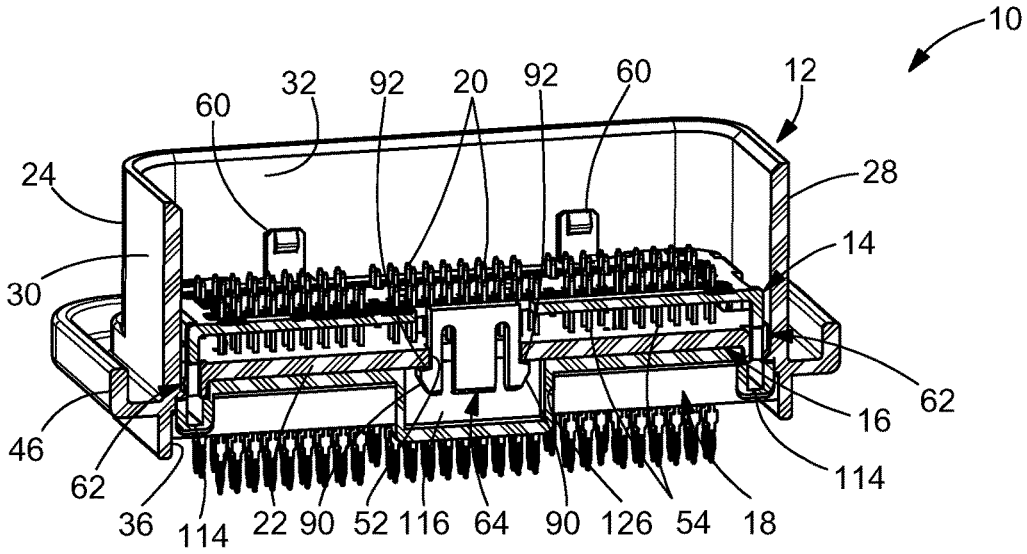
FIG. 3 is a perspective cross-sectional view of the sealed header of FIG. 2 taken along line 3-3 of FIG. 2, an alignment plate is shown in a first or shipping position.
Figure 4:
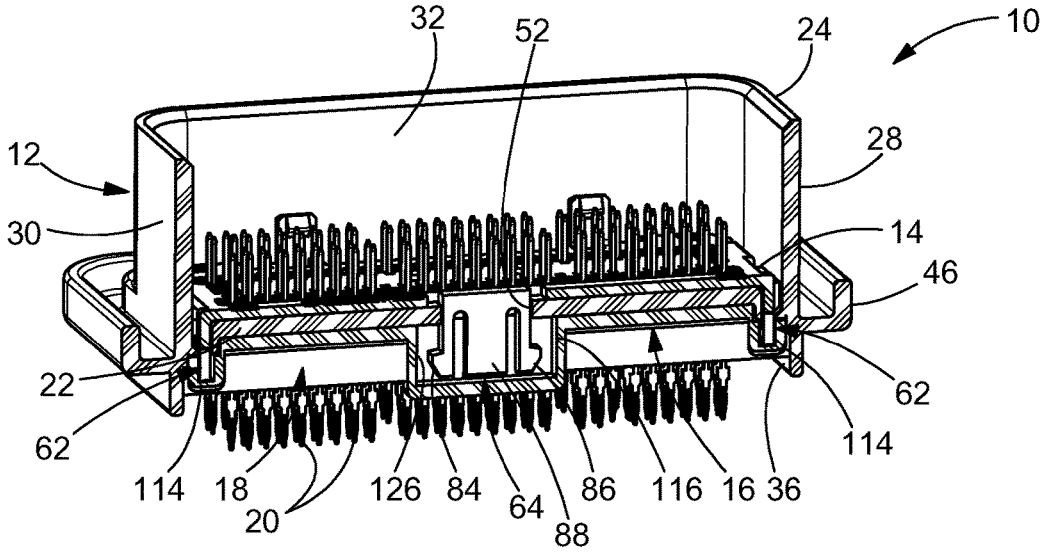
FIG. 4 is a perspective cross-sectional view of the sealed header of FIG. 1 taken along line 3-3 of FIG. 2, the alignment plate is shown in a second or mated position.
Figure 5:
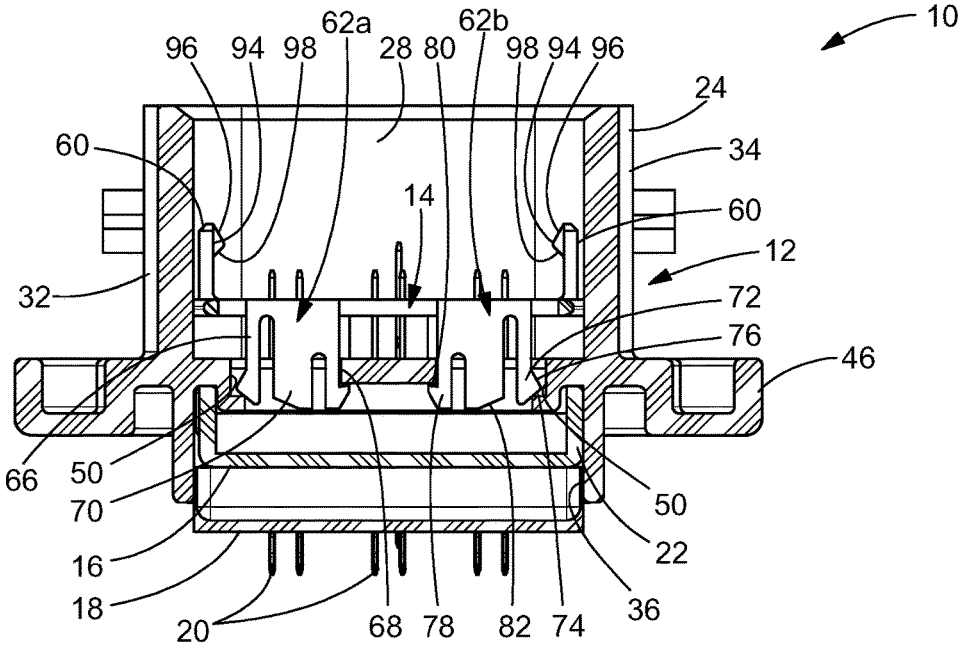
FIG. 5 is a cross-sectional view of the sealed header of FIG. 3 taken along line 5-5 of FIG. 3, the alignment plate is shown in the first or shipping position.
Figure 6:
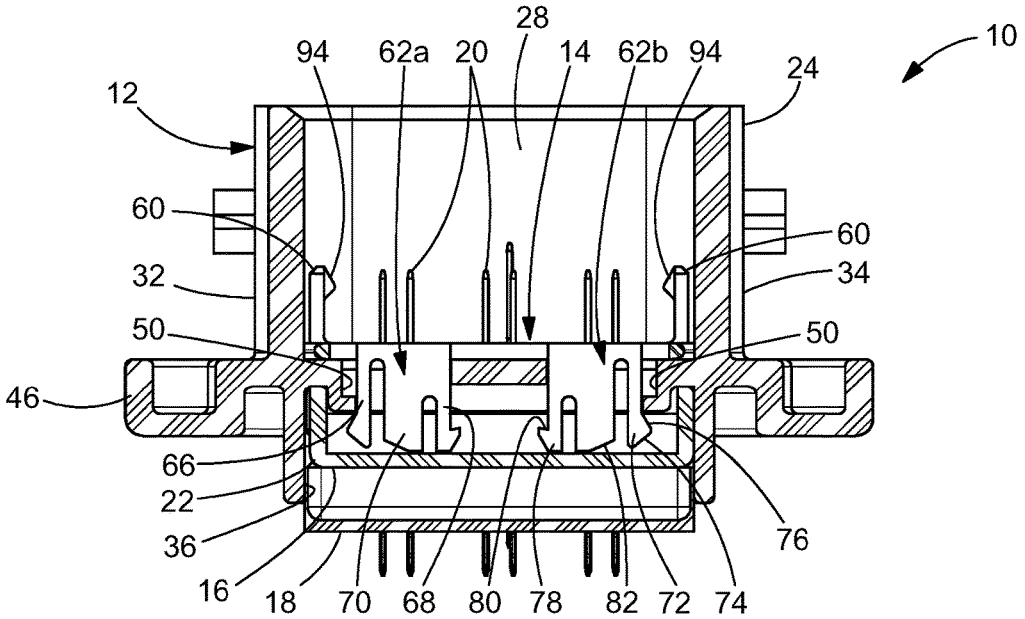
FIG. 6 is a cross-sectional view of the sealed header of FIG. 4 taken along line 6-6 of FIG. 4, the alignment plate is shown in the second or mated position.

As best shown in FIGS. 5 and 6, the bottom wall 22 has alignment plate latch receiving openings 50 which extend through the bottom wall 22 and are provided proximate end walls 28, 30. As best shown in FIGS. 3 and 4, the bottom wall 22 also has alignment plate retention member receiving openings 52 which extend through the bottom wall 22 and are spaced from the end walls 28, 30 and the side walls 32, 34. Terminal receiving openings 54 (FIG. 3) also extend through the bottom wall 22. It should be appreciated that the terminal receiving openings 54 are profiled according to the particular contacts or terminals 20 positioned in the housing 12.

As best shown in FIG. 1, the alignment plate 14 includes a plate portion 56 with a plurality of terminal receiving openings 58 extending therethrough. The plate portion 56 also has mating connector cooperation members 60, housing latching members 62 and housing retention members 64. It should be appreciated that the terminal receiving openings 58 are profiled according to the particular contacts or terminals 20 positioned in the housing 12.

Referring to FIGS. 5 and 6, in the embodiment shown, two housing latching members 62*a*, 62*b* are provided at the ends of the alignment plate 14 (FIG. 1) proximate each side wall 32, 34 of the shroud 24. Each of the housing latching members 62 has a pre-stage finger or flexible spring arm 66, a retention finger or retention arm 68 and a guide member 70. The spring arm 66 has a projection 72 which extends from a side thereof in a direction away from the retention arm 68. The projection 72 has a first sloped surface 74, provided proximate the free end of the spring arm 68, and a second sloped surface 76 spaced from the first sloped surface 74. The retention arm 68 has a projection 78 which extends from a side thereof in a direction away from the spring arm 66. The projection 78 has a latching shoulder 80. The guide member 70 has a sloped surface 82 provided proximate the free end thereof. It should be appreciated that the housing latching members 62*a*, 62*b* are identical to each other but a mirror image of each other.

In the embodiment shown, two housing retention members 64 are shown (FIG. 1). The housing retention members 64 are positioned proximate the center of the alignment plate 14. As best shown in FIGS. 3 and 4, each of the housing retention members 64 has a first flexible spring arm 84, a second flexible spring arm 86 and a support member 88 positioned between the spring arms 84, 86. Each spring arm 84, 86 has a projection 90 which extends from a side thereof in a direction away from the support member 88. Each projection 90 has a retention shoulder 92. In the embodiment shown, the housing retention members 64 are identical to each other but are spaced apart from each other.

In the embodiment shown, four mating connector cooperation members 60 are shown extending from sides of the alignment plate 14. Each of the mating connector cooperation members 60 are upstanding spring arm latches which cooperate with a mating connector (not shown) when the mating connector is inserted into the shroud 24 to mate with header assembly 10. As best shown in FIGS. 3 and 4, each mating connector cooperation member 60 includes a projection 94 which extends in a direction toward an oppositely facing mating connector cooperation member 60. The projection 94 has a first sloped surface 96, provided proximate the free end of the mating connector cooperation member 60, and a second sloped surface 98 spaced from the first sloped surface 96. In the embodiment shown, the mating connector cooperation members 60 are identical. The projections 94 cooperate with a mating connector to maintain the mating connector in a pre-stage position as required.

As best shown in FIGS. 1, 3 and 4, back plate 16 includes a plate portion 110 with a plurality of terminal receiving slots 112 extending therethrough. It should be appreciated that the terminal receiving slots 112 are profiled according to the particular contacts or terminals 20 positioned in the housing 12. The plate portion 110 also has housing latching member receiving projections 114, positioned proximate ends thereof, and housing retention member receiving projections 116, positioned proximate the center thereof. It should be appreciated that the terminal receiving openings 58 are profiled according to the particular contacts or terminals 20 positioned in the housing 12. The back plate 16 is dimensioned to be received recess 36 of the housing 12 such that the housing latching member receiving projections 114 and housing retention member receiving projections 116 extend in a direction away from the bottom wall 22 of the housing 22.

As best shown in FIGS. 3 and 4, the sealant 18 is a liquid type sealant or epoxy which is dispensed and set around the terminals 20 applied after the back plate 16 has been positioned in the recess 36 of the housing 12. The configuration of the back plate 16 prevents the sealant or epoxy from entering the openings 50, 52 of the bottom wall 22. The sealant is retained in the recess 36 and flows around the terminals 20 and around the housing retention member receiving projections 116 forming openings which conform to the terminals 20 and the housing retention member receiving projections 116. The sealant prevents moisture or contaminants from entering the housing 12 through the bottom wall 22. For purposes of illustration the sealant 18, which has been dispensed and set in the recess 36, has been exploded from the alignment plate 14 to better show the features of the alignment plate 16. In alternative embodiments, a preformed sealant or seal may be used and applied to the recess 36.

As shown in FIGS. 3 and 5, the alignment plate 14 is shown in a first, pre-stage or shipping position. In this position, the latching shoulders 80 of the retention arms 68 of the latching members 62 engage a bottom surface of the bottom wall 22 of the housing 12 proximate the alignment plate latch receiving openings 50. In this first position, the retention shoulders 92 of the spring arms 84, 86 of the housing retention members 64 engage the bottom surface of the bottom wall 22 of the housing 12 proximate the alignment plate retention member receiving openings 52. The cooperation of the latching shoulders 80 and retention shoulders 92 with the bottom wall 22 prevents the alignment plate 14 from moving away from the bottom wall 22. Also in the first position, the first sloped surfaces 74 of the spring arms 66 of the latching members 62 engage a top surface of the bottom wall 22 of the housing 12 proximate the alignment plate latch receiving openings 50. The cooperation of the latching first sloped surfaces 74 with the bottom wall 22 prevents the alignment plate 14 from moving toward the bottom wall 22, unless a sufficient force is applied to the alignment plate 14 in order to resiliently deform the spring arms 66 causing the first sloped surfaces 74 to move into the alignment plate latch receiving openings 50. A sufficient force may be applied by a mating connector (not shown) being inserted into the shroud 24 of the housing 12. The amount of force required is dependent upon the slope of the first sloped surfaces 74 and the spring rate of the spring arms 66.

In the first position, the alignment plate 14 is spaced from the bottom wall 22 of the housing 12. This allows the alignment plate 14 to be positioned nearer to the free ends of the terminals 20 to provide structural support to the terminals 20 proximate their free ends while still allowing a probe to access the terminals 20. In so doing, the alignment plate 14 provides protection to the free ends of the terminals 20, preventing the terminals 20 from being deformed or damaged prior to the insertion of the mating connector into the shroud 24 of the housing 12. For example, the alignment plate 14 may shield the terminals 20 from objects that inadvertently enter the shroud 24. In some embodiments, the alignment plate 14 may align and/or hold the terminals 20 in designated positions to reduce the likelihood of stubbing during the mating operation. Optionally, the alignment plate 14 may be configured to function as a cover that reduces the likelihood of contaminants (e.g., dust) entering the shroud 24.

Also in the first position, the first sloped surfaces 74 of the spring arms 66 of the latching members 62 engage a top surface of the bottom wall 22 of the housing 12 proximate the alignment plate latch receiving openings 50. The cooperation of the first sloped surfaces 74 with the bottom wall 22 prevents the alignment plate 14 from moving toward the bottom wall 22, unless a sufficient force is applied to the alignment plate 14 in order to resiliently deform the spring arms 66 causing the first sloped surfaces 74 to move into the alignment plate latch receiving openings 50. A sufficient force may be applied by a mating connector (not shown) being inserted into the shroud 24 of the housing 12. The amount of force required is dependent upon the slope of the first sloped surfaces 74 and the spring rate of the spring arms 66.

As the mating connector is inserted into the shroud 24, the mating connector moves past the projections 94 of the mating connector cooperation members 60 and engages the plate portion 56. Continued insertion of the mating connector provides sufficient force to cause the spring arms 66 to resiliently deform inward toward the guide member 70 which in turn causes the first sloped surfaces 74 to move into the alignment plate latch receiving openings 50. This allows the spring arms 66 to move into the alignment plate latch receiving openings 50 and the plate portion 56 to move toward the bottom wall 22. The insertion of the mating connector continues until the plate portion 56 engages the bottom wall 22. In this final or fully inserted position, the terminals of the mating connector are placed and maintained in electrical contact with the terminals 20 of the header assembly 10. Also in this final position, as shown in FIG. 6, the projections 94 are positioned below the bottom wall 22, allowing the spring arms to resilient return to or toward their unstressed position. In this final position, the second sloped surfaces 76 of the projections 94 are positioned proximate to or in engagement with the bottom surface of the bottom wall 22, thereby preventing the inadvertent movement of the spring arms 66 and alignment plate 14 from the final position. The amount of force required to return the alignment plate 14 to its first position is dependent upon the slope of the second sloped surfaces 76 and the spring rate of the spring arms 66.

The use of the alignment plate 14 and back plate 16 allows for a header assembly which can be sealed when mated or unmated.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector assembly comprising:

a housing having a bottom wall and a shroud extending therefrom, a recess provided in the housing proximate the bottom wall, the recess extending in a direction away from the shroud;

an alignment plate having housing latching members and housing retention members, the housing latching members extending through latch receiving openings in the bottom wall of the housing, the housing latching members and the alignment plate being movable between a first position and a second position, the housing retention members extending through retention member receiving openings in the bottom wall of the housing;

a back plate positioned in the recess of the housing, the back plate having latching member receiving projections for receiving the housing latching members when the alignment plate is in the second position and retention member receiving projections for receiving the housing retention members; and a sealant positioned in the recess of the housing, the sealant forming openings which conform to the housing retention member receiving projections.

2. The electrical connector assembly as recited in claim 1, wherein the housing latching members have flexible spring arms and retention arms.

3. The electrical connector assembly as recited in claim 2, wherein the spring arms have projections which extend from sides thereof in a direction away from the retention arms, the projections have a first sloped surface provided proximate free ends of the spring arms and second sloped surfaces spaced from the first sloped surfaces.

4. The electrical connector assembly as recited in claim 3, wherein the retention arms have projections which extend from sides thereof in a direction away from the spring arms, the projections have latching shoulders.

5. The electrical connector assembly as recited in claim 4, wherein guide members are positioned between the flexible spring arms and retention arms, the guide members have sloped surfaces provided proximate free ends of the guide members.

6. The electrical connector assembly as recited in claim 5, wherein two housing latching members are provided on each end of the alignment plate.

7. The electrical connector assembly as recited in claim 4, further comprising:

the alignment plate including mating connector cooperation members extending from sides of the alignment plate.

8. The electrical connector assembly as recited in claim 7, wherein the mating connector cooperation members are upstanding spring arm latches, the mating connector cooperation members include projections which extend in a direction toward an oppositely facing mating connector cooperation member, the projections have first sloped surfaces, provided proximate free ends of the mating connector cooperation members, and second sloped surfaces spaced from the first sloped surfaces.

9. The electrical connector assembly as recited in claim 1, wherein the housing retention members have first flexible spring arms, second flexible spring arms and a support member positioned between the first and second spring arms.

10. The electrical connector assembly as recited in claim 9, wherein the first and second spring arm have projections which extend from sides thereof in a direction away from the support members, the projections retention shoulders.

11. An electrical connector assembly comprising:

a housing having a bottom wall and a shroud extending therefrom, a recess provided in the housing proximate the bottom wall, the recess extending in a direction away from the shroud, terminals extend through the bottom wall;

an alignment plate having housing latching members and housing retention members, the housing latching members extending through latch receiving openings in the bottom wall of the housing, the housing retention members extending through retention member receiving openings in the bottom wall of the housing, the housing retention members have first flexible spring arms, second flexible spring arms a support member positioned between the first and second spring arms, the housing latching members, the housing retention members and the alignment plate being movable between a first position and a second position;

a back plate positioned in the recess of the housing, the back plate having latching member receiving projections for receiving the housing latching members when the alignment plate is in the second position, the back plate having retention member receiving projections for receiving the housing retention members.

12. The electrical connector assembly as recited in claim 11, wherein the housing latching members have flexible spring arms and retention arms.

13. The electrical connector assembly as recited in claim 12, wherein the spring arms have projections which extend from sides thereof in a direction away from the retention arms, the projections have a first sloped surface provided proximate free ends of the spring arms and second sloped surfaces spaced from the first sloped surfaces.

14. The electrical connector assembly as recited in claim 13, wherein the retention arms have projections which extend from sides thereof in a direction away from the spring arms, the projections have latching shoulders.

15. The electrical connector assembly as recited in claim 14, wherein guide members are positioned between the flexible spring arms and retention arms, the guide members have sloped surfaces provided proximate free ends of the guide members.

16. The electrical connector assembly as recited in claim 11, wherein the first and second spring arm have projections which extend from sides thereof in a direction away from the support members, the projections have retention shoulders.

17. An electrical connector assembly comprising:

a housing having a recess provided in the housing proximate a bottom wall;

an alignment plate having housing latching members and housing retention members, the housing latching members extending through latch receiving openings in the bottom wall of the housing, the housing retention members extending through retention member receiving openings in the bottom wall of the housing;

a back plate positioned in the recess of the housing proximate the bottom wall, the back plate having latching member receiving projections for receiving the housing latching members and retention member receiving projections for receiving the housing retention members.

18. The electrical connector assembly as recited in claim 17, wherein the housing latching members have flexible spring arms and retention arms, the retention arms have projections which extend from sides thereof in a direction away from the spring arms, the projections have latching shoulders.

19. The electrical connector assembly as recited in claim 17, wherein the spring arms have projections which extend from sides thereof in a direction away from the retention arms, the projections have a first sloped surface provided proximate free ends of the spring arms and second sloped surfaces spaced from the first sloped surfaces.

20. The electrical connector assembly as recited in claim 17, wherein the housing retention members have first flexible spring arms, second flexible spring arms a support member positioned between the first and second spring arms, the first and second spring arm have projections which extend from sides thereof in a direction away from the support members, the projections have retention shoulders.

* * * * *